US010128037B2

(12) United States Patent
Kim et al.

(10) Patent No.: US 10,128,037 B2
(45) Date of Patent: Nov. 13, 2018

(54) EMBEDDED SUBSTRATE CORE SPIRAL INDUCTOR

(71) Applicant: Avago Technologies International Sales Pte. Limited, Singapore (SG)

(72) Inventors: Namhoon Kim, Irvine, CA (US); Sampath Komarapalayam Karikalan, Irvine, CA (US); Zhihui Wang, Tustin, CA (US); Jin Seong Choi, Irvine, CA (US); Boon Leong Tan, Singapore (SG); Edward Law, Ladera Ranch, CA (US)

(73) Assignee: Avago Technologies International Sales Pte. Limited, Singapore (SG)

( * ) Notice: Subject to any disclaimer, the term of this patent is extended or adjusted under 35 U.S.C. 154(b) by 260 days.

(21) Appl. No.: 14/753,482

(22) Filed: Jun. 29, 2015

(65) Prior Publication Data

US 2016/0300661 A1 Oct. 13, 2016

Related U.S. Application Data

(60) Provisional application No. 62/171,612, filed on Jun. 5, 2015, provisional application No. 62/145,698, filed on Apr. 10, 2015.

(51) Int. Cl.

| | |
|---|---|
| ***H01F 5/00*** | (2006.01) |
| ***H01F 27/28*** | (2006.01) |
| ***H01F 27/29*** | (2006.01) |

(52) U.S. Cl.

CPC ..... *H01F 27/2804* (2013.01); *H01F 5/00* (2013.01); *H01F 27/29* (2013.01); *H01F 2027/2809* (2013.01)

(58) Field of Classification Search

CPC ..... H01F 5/00; H01F 27/00–27/36

(Continued)

(56) References Cited

U.S. PATENT DOCUMENTS 5,936,298 A * 8/1999 Capocelli ..... H01F 17/0033 257/531
7,332,993 B1 * 2/2008 Nussbaum ..... H01F 27/2804 336/200

(Continued)

FOREIGN PATENT DOCUMENTS

JP 2000269035 A * 9/2000

OTHER PUBLICATIONS

PCB Stackup Design Considerations for Altera FPGAs, Oct. 2010, pp. 1-26, Altera Corporation, San Jose, California.

(Continued)

*Primary Examiner* — Tuyen Nguyen
(74) *Attorney, Agent, or Firm* — Foley & Lardner LLP

(57) ABSTRACT

Inductors are fabricated in core layers according to a predefined semiconductor package manufacturing process rules. The inductors provide an embedded substrate trace inductor solution. The inductors may be part of an on-chip voltage regulator or any other circuit design. The inductors provide a core spiral structure to help increase inductance, particularly using magnetic field coupling between inductors. The core layers provide thicker and heavier conductive segments for the inductors, particularly as compared to inductors fabricated in build-up layers according to the semiconductor package manufacturing process rules.

11 Claims, 15 Drawing Sheets

(58) Field of Classification Search
USPC ..... 336/65, 83, 200, 232; 257/531
See application file for complete search history.

(56) References Cited

U.S. PATENT DOCUMENTS 8,368,501 B2 * 2/2013 Hazucha ..... H01F 17/0033 336/200
2004/0156177 A1 * 8/2004 Higashitani ..... H01L 23/3107 361/777
2008/0006882 A1 * 1/2008 Huang ..... H01L 28/10 257/379
2008/0079115 A1 * 4/2008 Wang ..... H01L 23/5227 257/531
2009/0115067 A1 * 5/2009 Okimoto ..... H01L 23/5389 257/774
2010/0225434 A1 * 9/2010 Wang ..... H01F 17/0013 336/200
2011/0049672 A1 * 3/2011 Okushima ..... H01L 23/5227 257/531

OTHER PUBLICATIONS

Blackshear, E.D., et al., The evolution of build-up package technology and its design challenges, Jul./Sep. 2005, pp. 641-661, IBM Journal of Research & Development, vol. 49, No. 4/5, International Business Machines Corporation, New York.
Wahby, Mahmoud, PCB design basics—part 1, Nov. 13, 2013, pp. 1-5, http://www.edn.com/design/pc-goard/4424239/1/PCB-design-basics.
Wahby, Mahmoud, PCB design basics—part 2, Nov. 13, 2013, pp. 1-7, http://www.edn.com/design/pc-board/4424239/2/PCB-design-basics.
Olney, Barry, Multilayer PCB Stackup Planning, 2011, pp. 1-9, In-Circuit Design Pty Ltd, Australia.

* cited by examiner

300

EMBEDDED SUBSTRATE CORE SPIRAL INDUCTOR

PRIORITY CLAIM

This application claims priority to provisional application Ser. No. 62/171,612, filed Jun. 5, 2015, and to provisional application Ser. No. 62/145,698, filed Apr. 10, 2015, which are entirely incorporated by reference.

TECHNICAL FIELD

This disclosure relates to inductors. This disclosure also relates to inductor fabrication in semiconductor substrates.

BACKGROUND

Rapid advances in electronics and communication technologies, driven by immense customer demand, have resulted in the widespread adoption of electronic devices of every kind. The inductor is a fundamental circuit component of these devices. Inductors have a wide range of circuit applications, and for instance provide a key building block for multi-phase switching voltage regulators. Improvements in inductor design will improve the design and implementation of many different types of circuits that include inductors.

DETAILED DESCRIPTION

Figure 1:
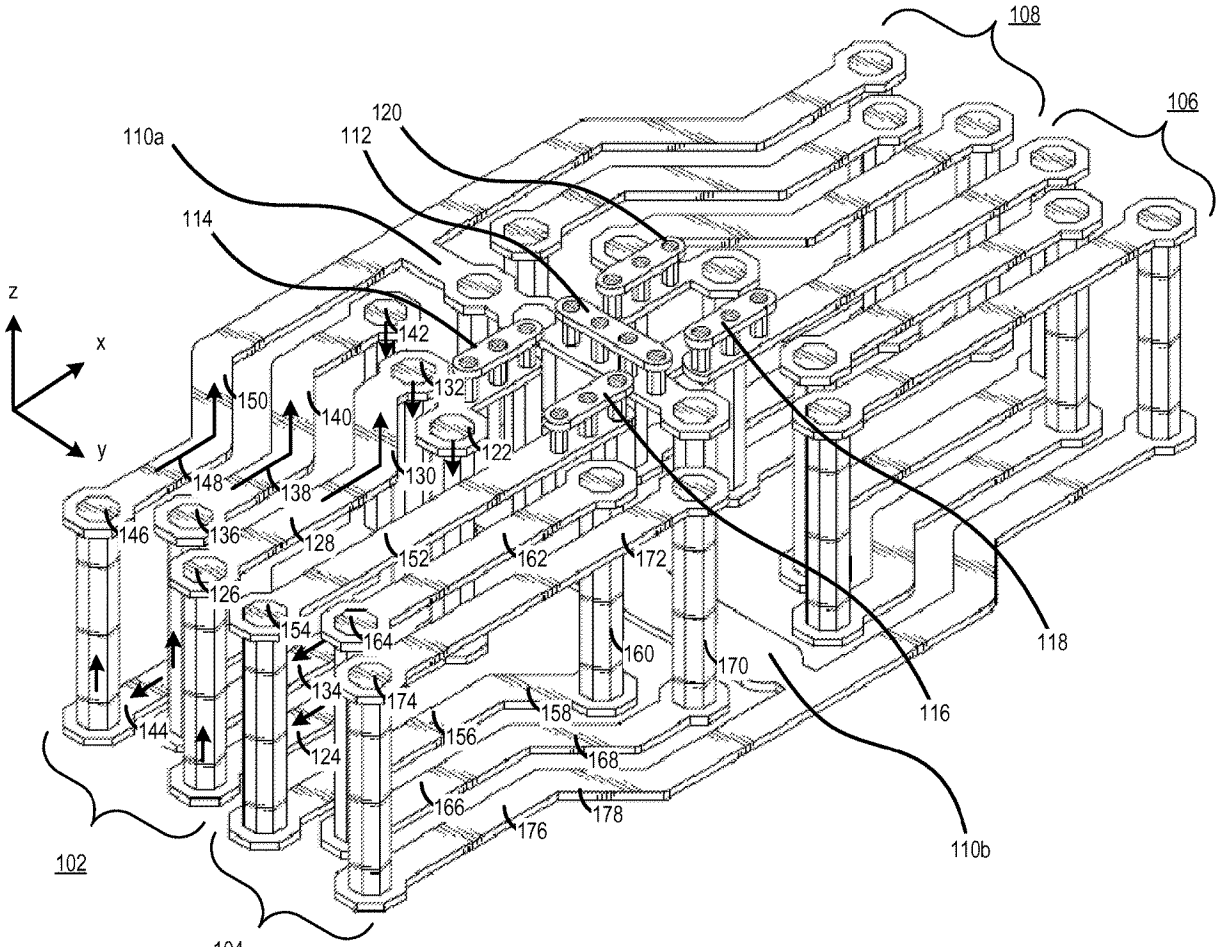
FIG. 1 shows an example of an inductor structure defining four inductors, each with three turns.

Inductors are important components in a wide variety of integrated circuit applications, including voltage regulators as just one example. There is often a significant current requirement for the inductors in these applications. The current requirements may limit on-chip inductor integration due to area requirements for supporting the current and the resultant cost increases. The inductor described below has a structure that includes passive substrate traces and has high current handling capability. The inductor may be implemented inexpensively in a package substrate, and may save die and system bill of materials (BOM) costs.

As a semiconductor package (e.g., flip-chip) layer, the core layer is often used to control warpage in the substrate. Larger packages use thicker core layers. The core layer may be implemented as a rigid material. The core layer is, e.g., 400 μm-800 μm, and is typically much thicker than, for instance, package build-up layers, which are typically about 30 μm thick and deposited on both sides of the layer. Tables 1 and 2 below provide examples of core layer and build-up layer materials. The design rules for the core layers tend to be coarser that for the build-up layers. For instance, the design rules may specify a 50 μm line width and space in the core layer as compared to a 12 μm line width and space in the build-up layer.

TABLE 1

| Core Layer | |
|---|---|
| Vendor | Material # |
| Naya CCL | NP180FB |
| Hitachi | E-679FG(R) |
| | E-700G(R) |
| | E-705G |
| | E-800G |
| Panasonic | R1515-A |
| | R1515-W |
| MGC | CCL-HL832HS |
| | CCL-HL832NX typeA-HS |
| | CCL-HL832NS |
| | CCL-HL832NS typeLC |
| | CCL-HL832NSR typeLC |
| | CCL-HL832NSR(LCA) |
| | CCL-HL832NSF(LCA) |
| Sumitomo | ELC-4785GS-B |
| | ELC-4785TH-B |
| | LAZ-4785TH-G |
| | LAZ-4785TH-GP |
| | LAZ-9980 |

TABLE 2

| Build-up Layer | |
|---|---|
| Vendor | Material # |
| Ajinomoto | GX-3 |
| | GX-13 |
| | GX-T31 |
| | GY-11 |
| | GX-92 |
| | GZ-41 |
| Sekisui | NX04H |

The inductor structure may include vias (e.g., conductive, filled, plated through holes) that traverse the thicker core layer. The vias may therefore be much longer than vias used to traverse thinner layers, such as the build-up layers. In the past, longer vias were sometimes associated with increased substrate inductance and increase supply noise, and given the coarser design rules for the core layer, the core layer discouraged use for electrical purposes.

Table 3 shows some example design rules for the core layer and Table 4 shows some example design rules for the build-up layer. In the core layer, the design rules permit copper thickness between, in these examples, 19 μm and 37 μm. In contrast, the coarser design rules for the build-up layers provide a much smaller maximum copper thickness, e.g., between 15 μm and 18 μm. Note that the thicker copper, e.g., 27 μm or more, may be used in the core layers for conductive traces, and the thicker copper provides additional current capacity for the inductor structures that are fabricated in the core layer.

TABLE 3

| Core Layer Example | CU Thickness (μm) | Min Pitch (μm) | Width Spec (μm) |
|---|---|---|---|
| 1 | 19 +/− 5 | 35-45 | 35-40 +/− 10-15 |
| 2 | 22 +/− 5 | 40-50 | 35-50 +/− 10-15 |
| 3 | 27 +/− 5 | 50-60 | 50-60 +/− 15 |
| 4 | 32 +/− 5 | 65-75 | 65-75 +/− 20 |
| 5 | 37 +/− 7 | 70-100 | 70-100 +/− 20-25 |

TABLE 4

| Build up layer example | CU Thickness (μm) | Min Pitch (μm) | Width Spec (μm) |
|---|---|---|---|
| 1 | 15 +/− 5 | 12 | 9-12 +/− 5 |
| 2 | 18 +/− 5 | 12-15 | 12-15 +/− 5 |

FIG. 1 shows an example of an inductor structure 100 defining four inductors 102, 104, 106, and 108 each with three turns. The inductors 102-108 have terminals that are connected together at one end by the common connections 110*a* and 110*b* (which are themselves connected by vias). However, in other implementations, each inductor may be an individual, separate component that does not share a common connection with any other inductor. The common connections 110*a*-110*b* and other structural components of the inductors 102-108 may be defined in whole or in part in a core layer of the package. Connections to the common connection 110*a*-110*b* may be made through traces and inductor terminal vias between other layers of the package, such as the signal layer 112.

In addition to the common connection 110*a*-110*b*, each inductor has a terminal that provides separate signal connection. FIG. 1 shows the signal connection 114 for the inductor 102, the signal connection 116 for the inductor 104, the signal connection 118 for the inductor 106, and the signal connection 120 for the inductor 108. The trace and via structures shown for the signal connections 112-118 are one example of how signals may be coupled to the inductors 102-108 from other signal layers of the package.

Note that the terminals and signal connections (e.g., the connections 112, 114, 116, 118, 120) shown in the drawings for any of the inductors need not be present. Instead, connections to either end of the inductors may be made internally to the package to any particular package layer or any particular circuitry on any particular layer through, e.g., vias and conductive traces through and on build-up layers. For instance, instead of including the common terminal 112, the inductors may connect directly to the Vddc plane of the package, while terminals 114-120 may connect to die bumps to connect to a voltage regulator. When the terminals are present, they may be used for measurement, testing purposes, or other purposes (including to connect to other circuitry).

The structure of each inductor 102-108 includes one or more turns that form a loop structure or spiral structure that creates the inductor magnetic field. Each turn may be fabricated, for instance, as a first conductive segment running in a first direction, a conductive via that defines vertical spacing, and a second conductive segment disposed to run current in a direction counter to (e.g., opposite) the first direction. The second conductive segment is vertically disposed from the first conductive segment. The conductive via connects the first conductive segment and the second conductive segment. Multiple turns may be connected together to form a larger inductor.

In FIG. 1 each inductor 102-108 includes three turns. The signal connection 114 provides a connection point to one end of the inductor 102. From the signal connection 114, the core via 122 extends vertically from a first core metal layer to the conductive segment 124 on a second core metal layer. The conductive segment 124 runs in one direction shown by the arrow, to the core via 126. The core via 126 extends vertically to the conductive segment 128 fabricated in the first core metal layer. The conductive segments may be implemented with copper traces that are relatively thick (compared to build-up layer thicknesses), as allowed by the core layer design rules, to increase current handling capability. Current in the conductive segment 128 runs in a direction opposed to the conductive segment 124. The conductive segment 128 includes a horizontal displacement 130. The horizontal displacement allows multiple conductive segments to run in parallel at the same vertical displacements in the core layer. The sequence of conductive structures 122, 124, 126, 128, and 130 form one turn of the inductor 102. The second turn includes the same sequence of conductive structures: via 132, segment 134, via 136, segment 138, and displacement 140. The third turn includes the conductive structures: via 142, segment 144, via 146, segment 148, and displacement 150. The second end of the inductor 102 connects to the common connection 110*a*-110*b*.

As another example, the signal connection 116 provides a connection point to one end of the inductor 104. From the signal connection 116, the conductive segment 152 runs in one direction to the core via 154. The core via 154 extends vertically to the conductive segment 156. Current in the conductive segment 156 runs in a direction opposed to the conductive segment 152. The conductive segment 156 includes a horizontal displacement 158 that connects to the core via 160. The horizontal displacement 158 allows multiple conductive segments to run in parallel at the same vertical displacements in the core layer. The sequence of conductive segments 152, 154, 156, 158, and 160 form one turn or loop of the inductor 104. The second turn or loop includes the same sequence of conductive structures: segment 162, via 164, segment 166, displacement 168, and via 170. The third turn or loop includes the conductive structures: segment 172, via 174, segment 176, and displacement 178. The inductors 106 and 108 include similar sequences of conductive structures.

Figure 2:
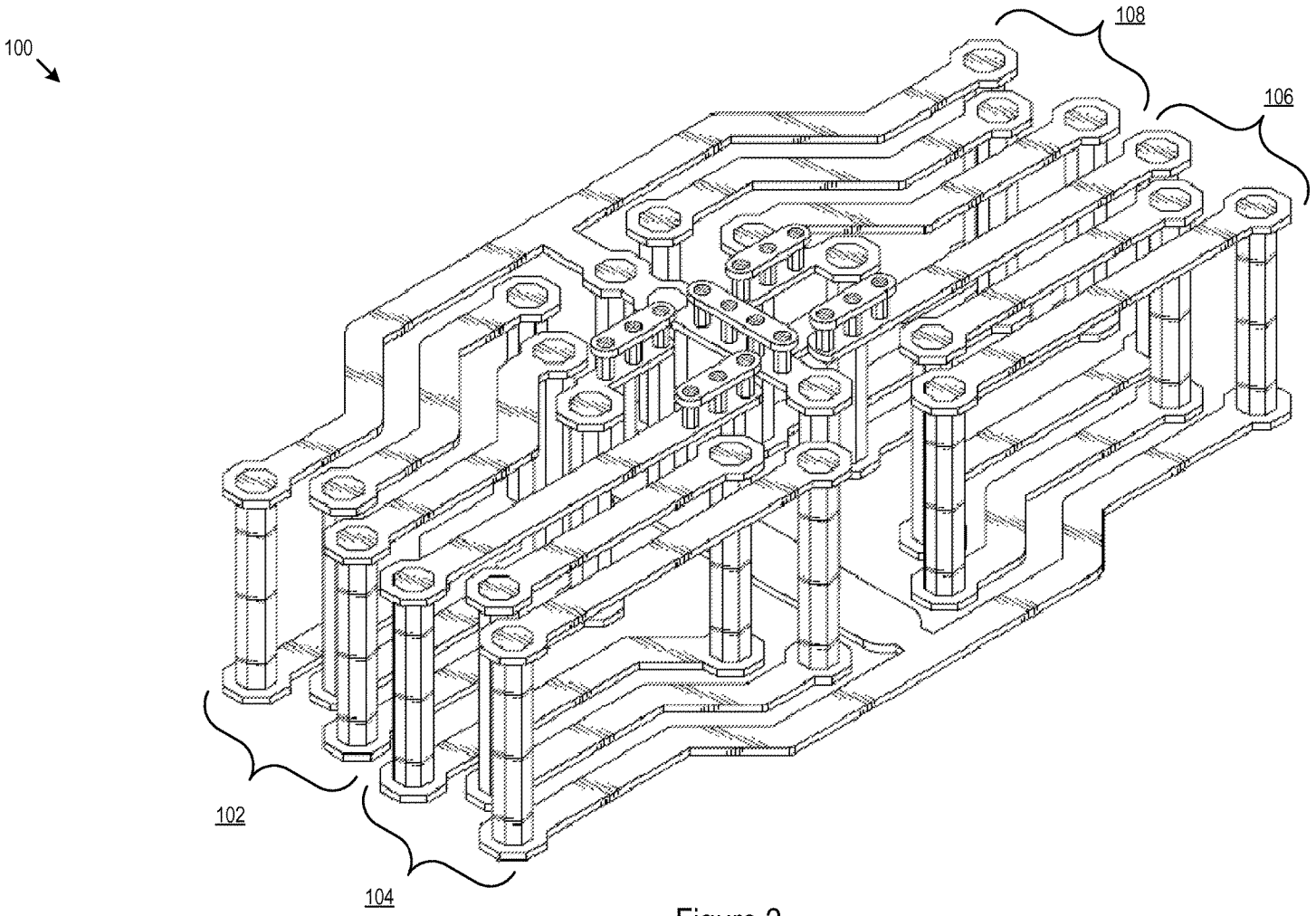
FIG. 2 shows the inductor of FIG. 1 with the majority of reference numbers and guidelines removed for clarity of view.

FIG. 2 shows the same view of the inductor 100 without the reference numbers, guide lines and guide arrows. Note that inductance may be increased by any combination of increasing the length of the conductive traces in the 'x' direction, by increasing the length of the core vias in the 'z' direction, and by adding more turns in the 'y' direction.

Figure 3:
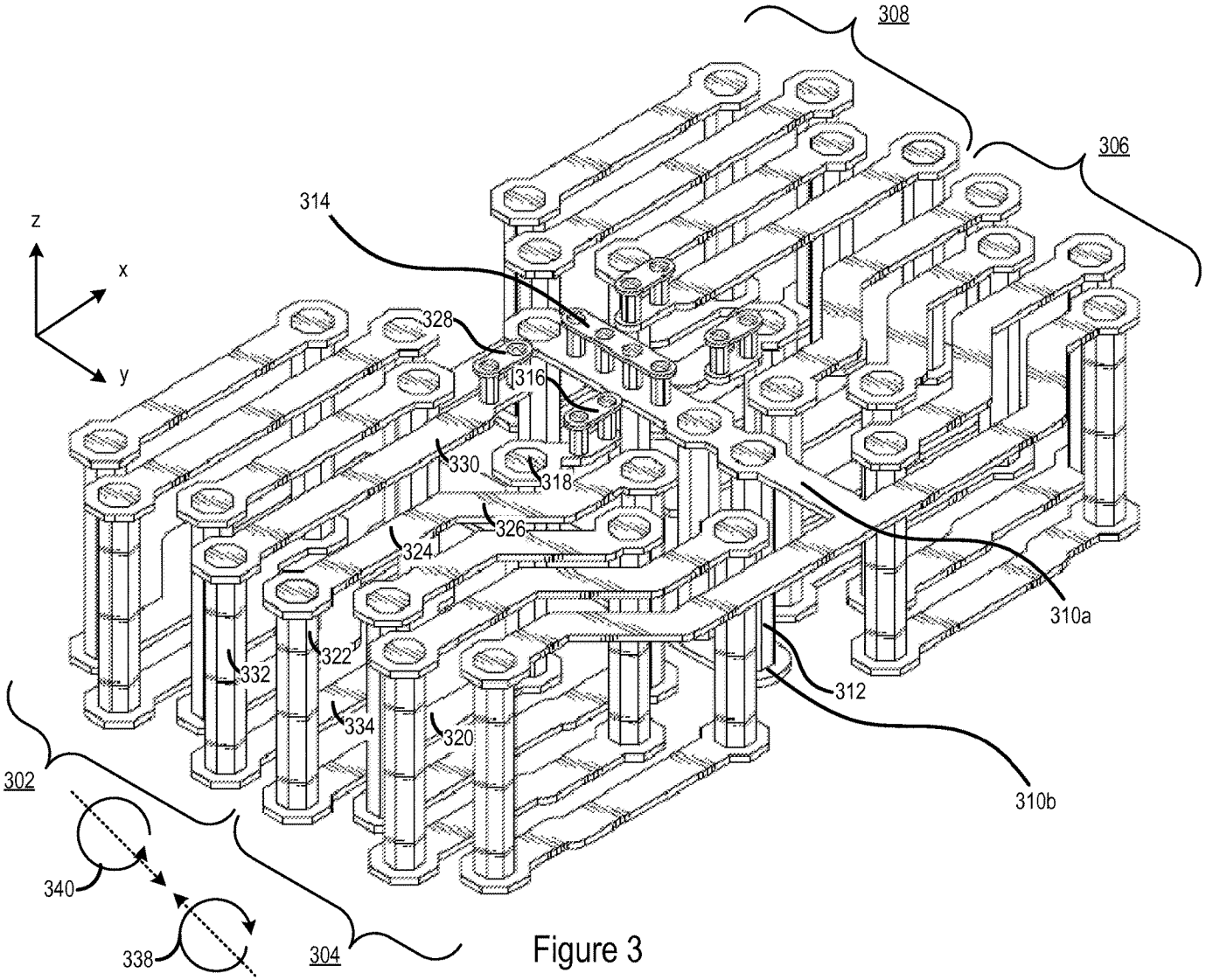
FIG. 3 shows an example of an inductor structure defining four inductors, each with four turns.

With regard to adding more turns, FIG. 3 shows an example of an inductor structure 300. The inductor structure 300 includes four inductors 302, 304, 306, and 308. Each inductor has four turns. In this example also, the inductors 302-308 are connected together at one end by the common connections 310*a* and 310*b* which are themselves connected by vias, e.g., the via 312. This particular structure may be useful when used in connection with a voltage regular circuit. However, in other implementations, any of the inductors may be individual, separate components, that do not share a common connection with any other inductor.

That is, any of the inductors may provide independent circuit elements for any particular circuitry other than voltage regulators. Connections to the common connection 310*a*-310*b* may be made through conductive traces and vias between other layers of the package, such as the signal layer 314.

The common connections 310*a*-310*b* and the other structural components of the inductors 302-308 may be defined in whole or in part in a core layer of the package. For example, the conductive segments of each inductor may include copper traces defined in one or more core metal layers. The copper traces may use relatively thick copper allowed by the core layer design rules to increase current handling capability, as noted above.

In addition to the common connection 110*a*-110*b*, each inductor has a separate signal connection at the other end of the inductor. With regard to the inductor 304, for instance, the signal connection 316 connects signal traces on other package layers to one end of the inductor 304. One turn of the inductor 304 includes the core via 318, conductive segment 320, core via 322, and the conductive segment 324 with the horizontal displacement 326.

Figure 4:
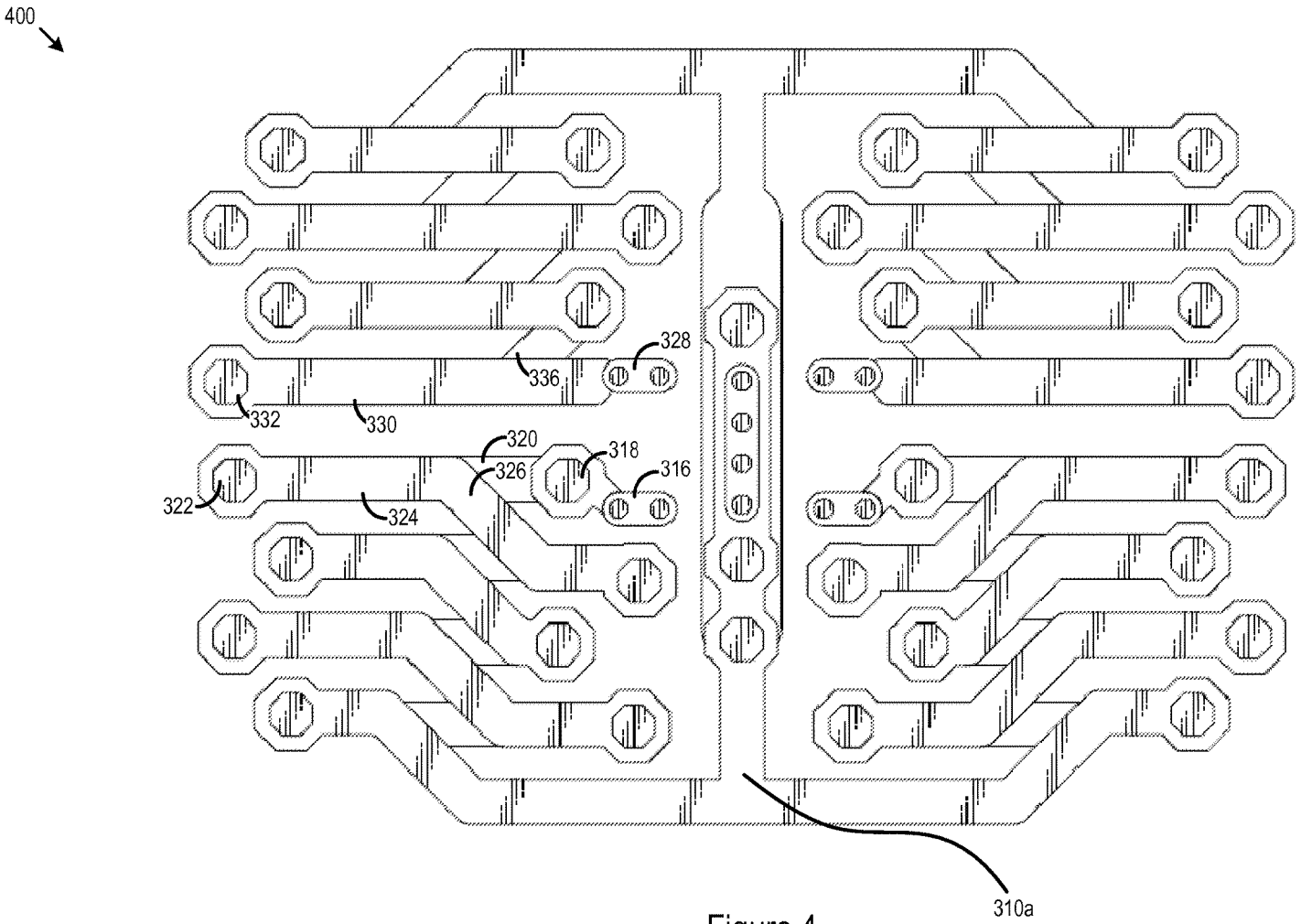
FIG. 4 shows a top view of the inductor of FIG. 3.
Figure 5:
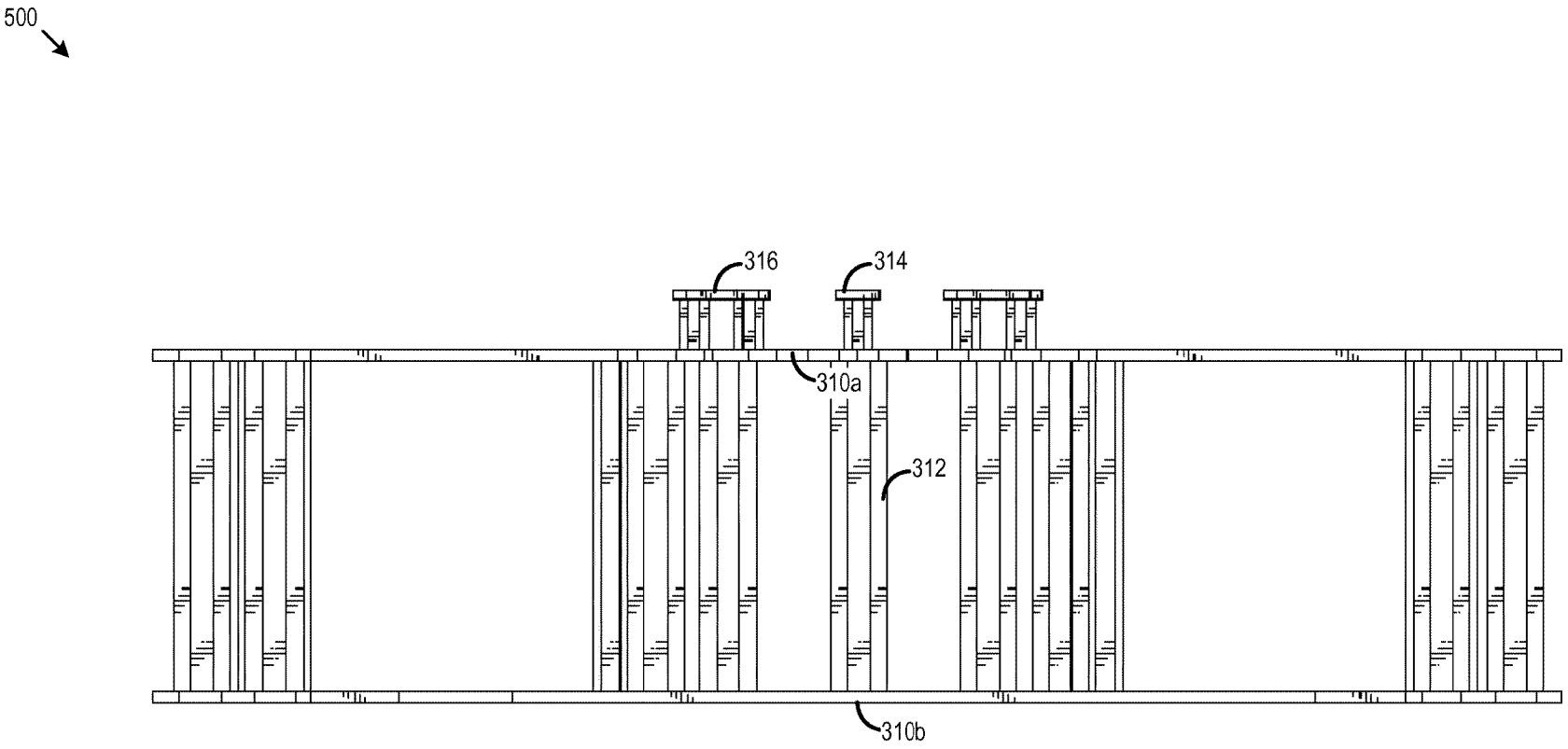
FIG. 5 shows a side view of the inductor of FIG. 3.
Figure 6:
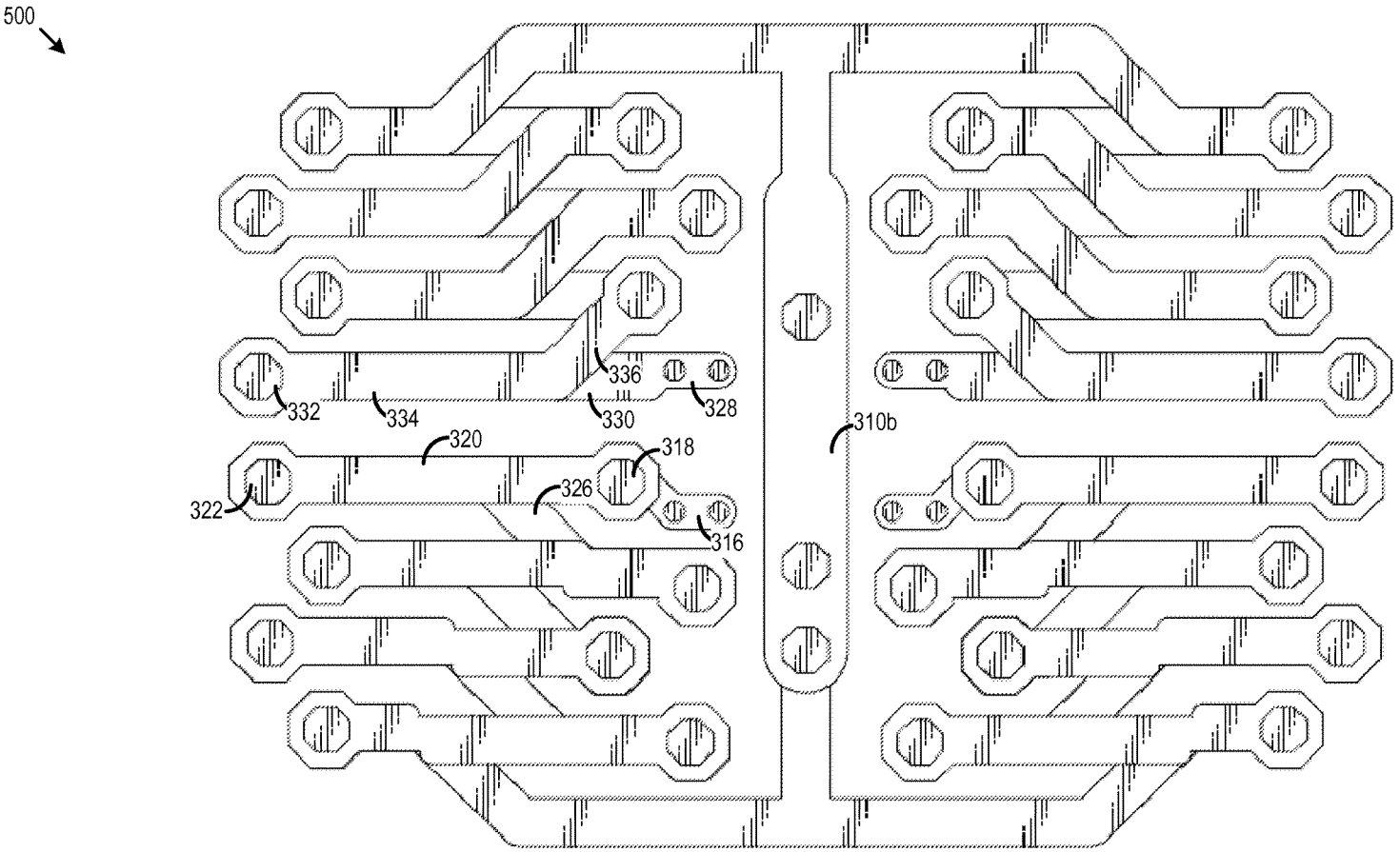
FIG. 6 shows a bottom view of the inductor of FIG. 3.

FIG. 4 shows a top view 400 of the inductors in FIG. 3. FIG. 5 shows a side view 500 of the inductors in FIG. 3. FIG. 6 shows a bottom view 600 of the inductors in FIG. 3. The first turn of the inductor 304 is labeled in each view, and each view shows the four turns of each of the four inductors 302-308. As a further example, the first turn of the inductor 302 is also labeled, including: the signal connection 328, conductive segment 330, core via 332, and conductive segment 334, and horizontal displacement 336.

Referring again to FIG. 3, the turns of the adjacent inductors 302 and 304, and turns of the adjacent inductors 306 and 308, are fabricated to direct current in opposite directions. As a specific example, the current flow 338 in the inductor 304 is opposite the current flow 340 in the inductor 302. As such, there is a constructive magnetic field with 180 degree phase inputs.

The constructive fields help to increase inductance in a given area, and thereby reduce total size of the inductors needed to achieve a given inductance. In other implementations, the inductors may be fabricated to cause current flow in the same direction, and not generate constructive magnetic fields. A time domain simulation may be run to determine the effects of coupled inductors on any given design under consideration.

Expressed another way, some inductors may be strongly coupled in the designs shown above. Larger mutual inductance may be used to increase the inductance (e.g., by 20-30% or more) based on input phase differences. This may facilitate a reduction in overall inductor size. The design reduces or minimizes the destructive magnetic field and makes the magnetic field constructive using the multi-phase inputs. As previously noted, the direction of the turns of adjacent inductors may be in opposite directions (e.g., as shown in FIGS. 1 and 3) to create a constructive magnetic field with 180 degree phase inputs.

Figure 10:
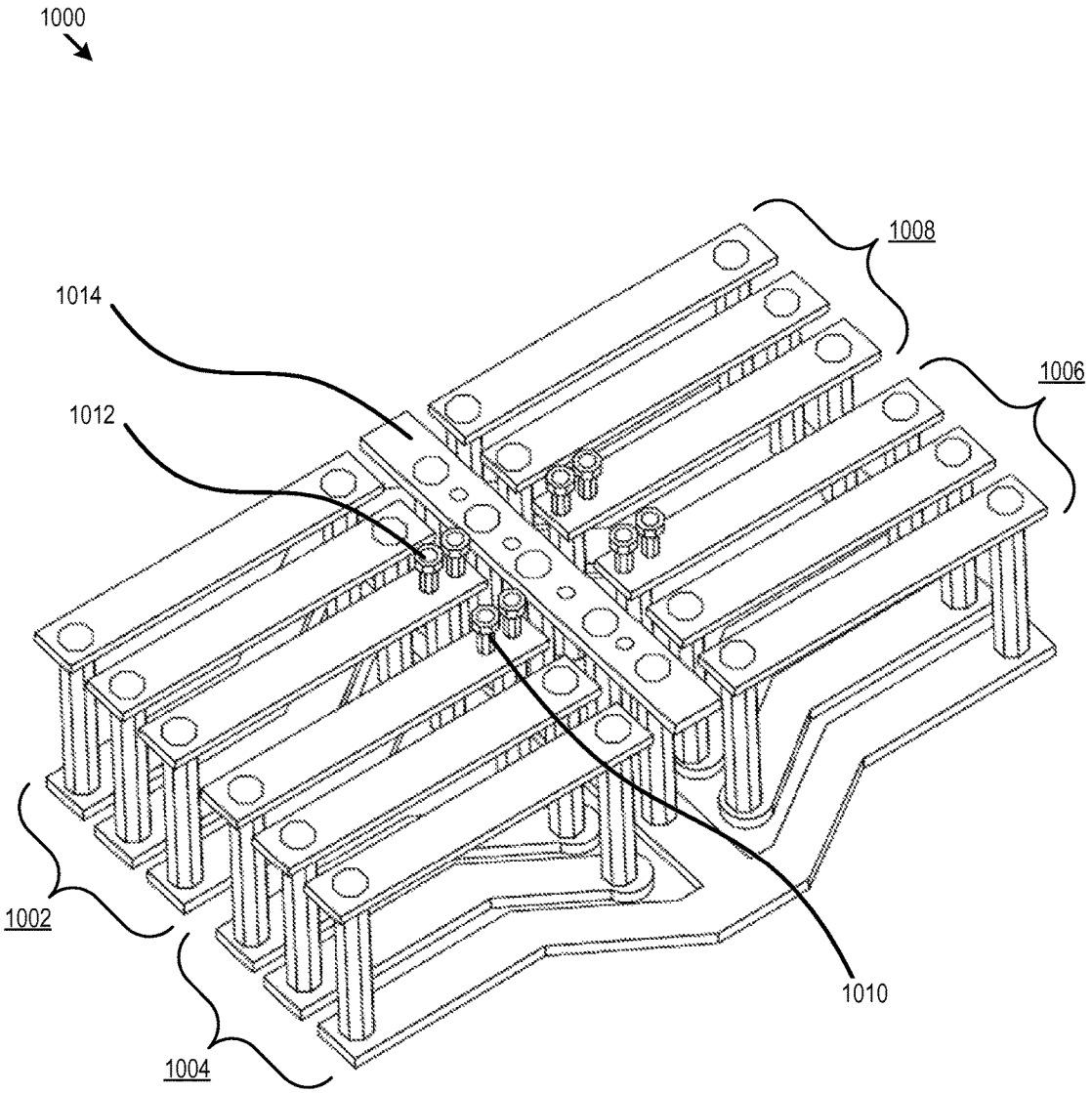
FIG. 10 shows an example inductor structure defining four inductors, each with three turns.
Figure 11:
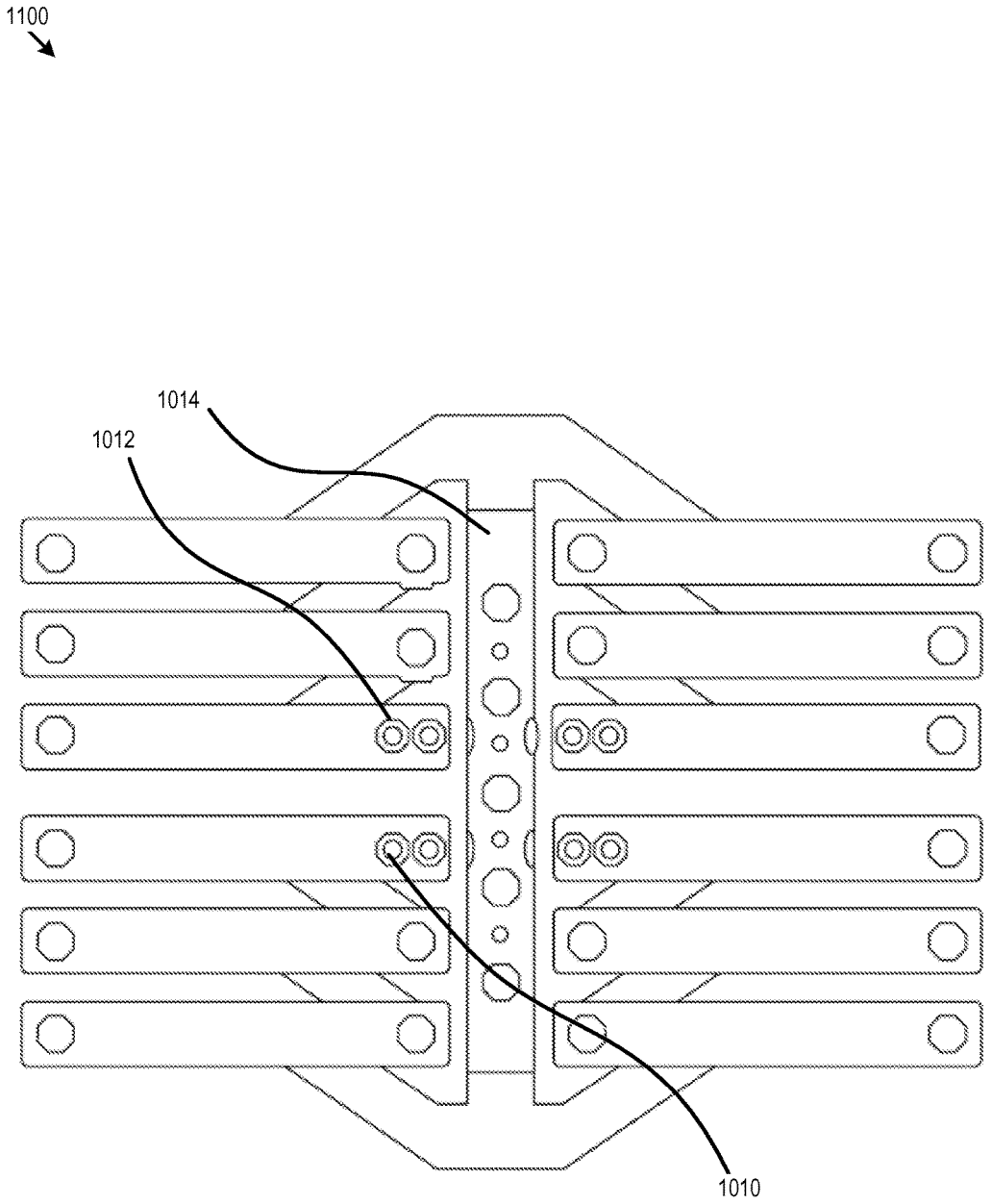
FIG. 11 shows a top view of the inductor of FIG. 10.
Figure 12:
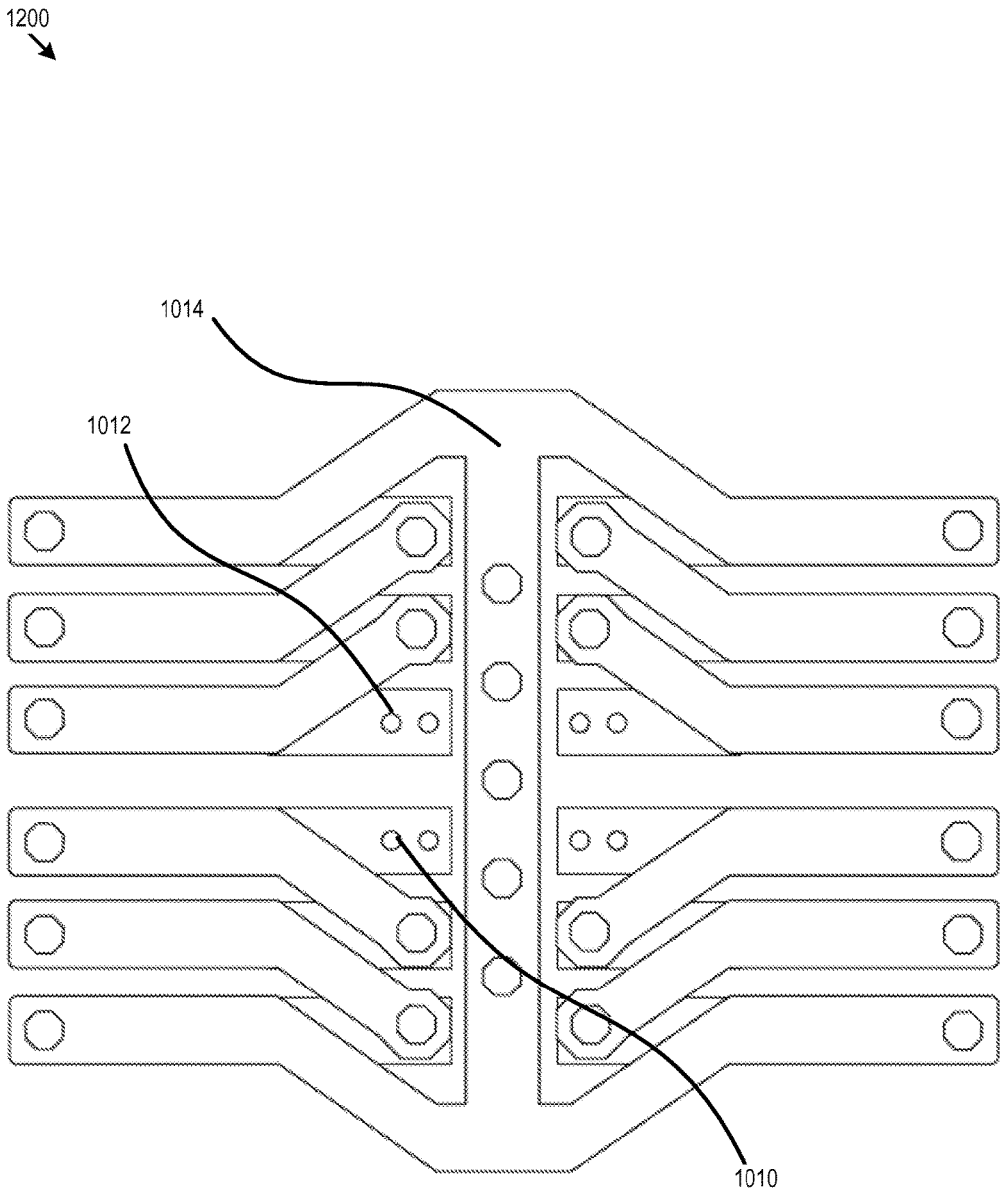
FIG. 12 shows a bottom view of the inductor of FIG. 10.

FIGS. 10-12, described below, show examples of inductors that do not use loops in opposite directions to create constructive magnetic fields to boost inductance. In the examples of FIGS. 10-12 the loops run in the same direction rather than in opposite directions. One advantage of having the loops in the same direction is that a more symmetrical structure is created, which may ease structural layout and optimization, and provide better control over structural variations.

The inductors may use a vertically folded structure using core layer vias. This reduces the Y size dimension. The core layer vias may be, e.g., 800 μm core vias. With the inductor traces fabricated in the core layers, the traces may use thicker copper (e.g., 19 μm to 75 μm thickness) for additional current capacity.

Figure 7:
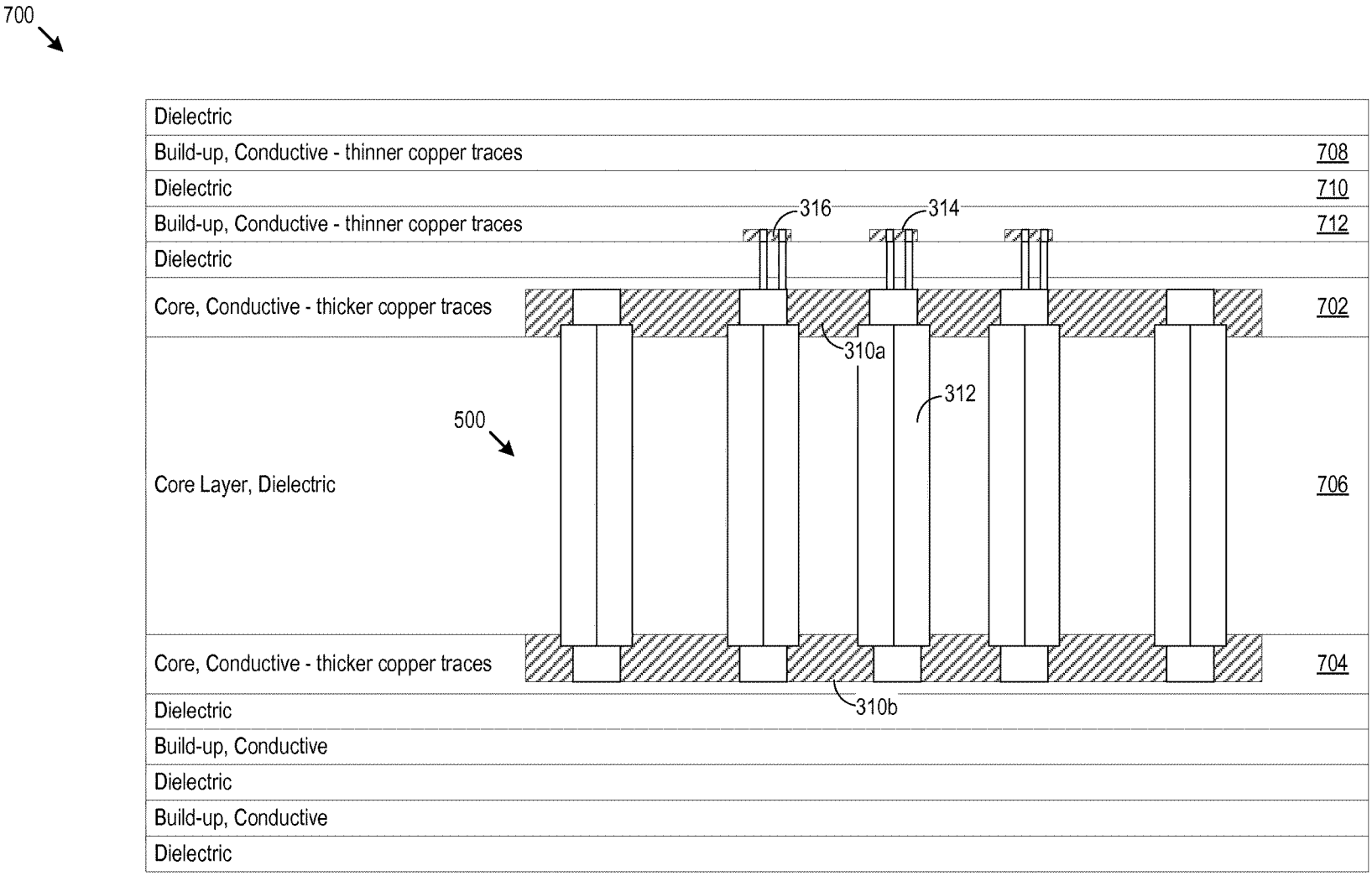
FIG. 7 shows a side view of build-up layers and core layers in a semiconductor package.

FIG. 7 shows a side view of build-up layers and core layers in a package 700. FIG. 7 also shows the side view 500 of the inductors of FIG. 3 superimposed over the package 700 to give an approximate representation of the distribution of structure through the package 700. The core layer includes a first core metal layer 702 and a second core metal layer 704. A core dielectric layer 706 separates the core metal layers 702, 704. There are several build-up layers shown as well, including the build-up metal layers 708 and 712, separated by the build-up dielectric layer 710.

All or part of the inductors may be fabricated in the core metal layers 702 and 704. Core vias may extend through the core layer 706 to connect the core metal layers 702 and 704. For instance, the conductive segments 324 and 326 may be fabricated in the core metal layer 702, and the conductive segment 320 may be fabricated in the core metal layer 704. The vias 318 and 322 may extend from the core metal layer 702 down to the core metal layer 704 to connect the conductive segments. In other implementations, some or all of the conductive segments may be fabricated in build-up metal layers instead.

The inductors are flexible and symmetric. They support 2x, 3x, 4x, or more series connection to increase inductance, e.g., with the 'y' size growing to increase inductance. Note also that the 'x' size may increase to increase inductance depending on the allowable area for the inductor when there is no interference with other signal routing in the substrate. The inductors may be fabricated in two core metal layers to save layer count, e.g., the two core metal layers 702 and 704. With the inductors internally defined at the core layers, instead of outer build-up layers, there is no need to depopulate solder balls adjacent the inductor structure, which reduces undesired coupling and improves reliability.

Figure 8:
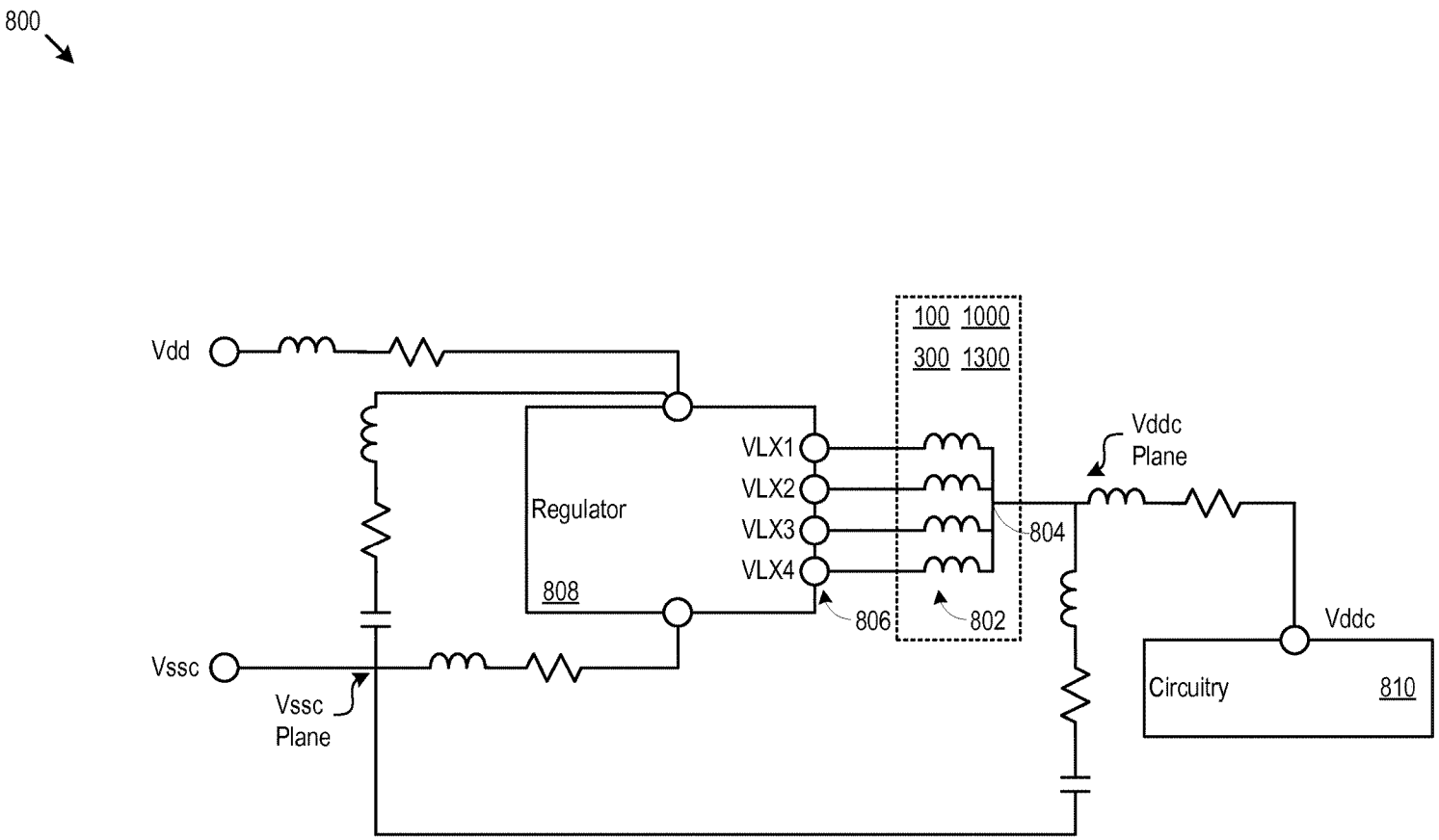
FIG. 8 shows an example multiphase voltage regulator block diagram.

FIG. 8 shows an example multiphase fully integrated switching regulator (FISR) power supply 800. The power supply 800 includes four inductors 802, one for each of the four phase FISR inputs. The inductors 802 share a common output 804, and have four independent inputs 806 connected to the regulator circuitry 808. The power supply 800 generates the output voltage Vddc from the unregulated Vddc-Vssc voltage. The output voltage Vddc supplies power to any desired circuitry 810, such as processors, memories, or other circuitry. The power supply 800 and inductor structure supports dynamic changes to the desired output voltage of the power supply 800. This may be done, e.g., to dynamically change voltage for a processor core to save power, or to boost power to the core for improved processor core performance.

The four inductors 802 may be implemented with the inductor structure 100 or 300, for example. In that case, the conductive segments of the inductors may be fabricated in core metal layers within a package for additional current handling capability.

Table 5 shows some example characteristics of power supply designs with 1, 2, and 4 phases, using the inductor structures described above, compared against 40 nm designs using field effect transistors (FETs) on the package. The BoM cost can be reduced significantly (e.g., by 76% to 87%), using the inductor structures 100, 300 and depending on the current requirements. The cost savings is achieved in part due to the elimination of the cost of the FETs, and the change to pattern inductors from wire wound inductors.

TABLE 5

| Description | Frequency | Inductance | Supply | Phase | Current |
|---|---|---|---|---|---|
| Internal FETs with inductor integrated into package substrate | 10-500 MHz | Pattern Inductor (nH) 1-20 nH per phase | 0-3.3 V supply | 4<br>2<br>1 | 0-10 A<br>0-10 A<br>500 mA |

| Phase | Efficiency | Cost | Die Area | PKG Stackup | Savings |
|---|---|---|---|---|---|
| 4 | ~88% | 0.16 (C * 3 + DIE cost) | 0.6 mm^2 | 3-2-3 | 80.18% |
| 2 | ~85% | 0.09 (C * 2 + DIE cost) | 0.325 mm^2 | 3-2-3 | 76.85% |
| 1 | ~85% | 0.05 (C * 1 + DIE cost) | 0.22 mm^2 | 3-2-3 | 86.93% |

The inductor design helps meet challenging design requirements, including low resistance, e.g., DCR ~10 mOhm to 100 mOhm, ACR ~100 mOhm to 300 mOhm and high inductance, e.g., 2 nH to 20 nH for processors and memory, to use a switching speed of ~50 MHz to 200 MHz, as examples. The inductor also helps support better FISR efficiency, e.g., ~90% target efficiency and a current capacity of e.g., 2A for a processor core and, 1A for double data rate (DDR) memory. The inductor design also helps implement multiphase designs, such as a 4 phase design with reduced output voltage ripple, with a 500 mA (processor core) and 250 mA (DDR memory) current capacity for each inductor.

The inductor design achieves the following gains, in some implementations, compared to existing fabrication techniques: Gained Inductance for processor: 7.0 nH→8.5 nH (21.4%); Gained Inductance for DDR memory: 8.9 nH→10.6 nH (19.1%). The proposed coupled inductor structure provides, e.g., 20-30% more inductance than conventional non-coupled inductor structures.

Table 6, below, shows example electrical characteristics for the inductor designs, fabricated at different sizes. Table 6 (and Table 7) provides just a few examples of many different variations in design possible with the inductor structures. Other designs may be implemented that have significantly different total area, width, height, maximum current, inductance, and other electrical parameters.

TABLE 6

| Total Area [mm$^2$] | Width [um] | Height [um] | MAX RMS Current [mA] | Inductance @100 MHz [nH] | DC Resistance [mOhm] | AC Resistance [mOhm] 50 MHz | AC Resistance [mOhm] 100 MHz | Q Factor @ 100 MHz |
|---|---|---|---|---|---|---|---|---|
| 2.1 × 4.0 | 256 | 27 | 500 mA | 9.01 | 33 | 100 | 137 | 41.2 |
| 1.9 × 4.0 | 216 | 32 | 500 mA | 9.78 | 33 | 108 | 155 | 39.7 |
| 1.9 × 3.5 | 216 | 32 | 500 mA | 8.45 | 30 | 99 | 139 | 38.4 |
| 1.6 × 3.5 | 187 | 37 | 500 mA | 9.07 | 30 | 108 | 155 | 36.7 |
| 1.6 × 3.0 | 187 | 37 | 500 mA | 7.71 | 26 | 97 | 137 | 35.3 |

The results achieve 20-50% horizontal area reduction and achieve better inductance and resistance than, e.g., 15 μm build-up layer inductors. There is also a layer count reduction from four layers with 15 μm build-up layer inductors to two layers with the core layer inductors described above.

Table 7, below, shows example core layer inductor RLC values by manufacturing variation. As with the examples provided in Table 6, other designs may be implemented that have significantly different total area, width, height, maximum current, inductance, and other electrical parameters.

TABLE 7

| Total Area [mm$^2$] | Width [um] | Height [um] | MAX RMS Current [mA] | Inductance @100 MHz [nH] | DC Resistance [mOhm] | AC Resistance [mOhm] 50 MHz | AC Resistance [mOhm] 100 MHz | Q Factor @ 100 MHz |
|---|---|---|---|---|---|---|---|---|
| 2.0 × 3.5 | 240 | 37 | 600 mA | 8.07 | 25 | 93 | 131 | 38.7 |
| 2.0 × 3.5 | 240 | 32 | 540 mA | 8.07 | 27 | 93 | 130 | 39.1 |
| 2.0 × 3.5 | 240 | 42 | 658 mA | 7.98 | 23 | 90 | 129 | 38.9 |
| 2.0 × 3.5 | 220 | 32 | 507 mA | 8.42 | 29 | 98 | 137 | 38.7 |
| 2.0 × 3.5 | 260 | 32 | 572 mA | 7.76 | 26 | 88 | 123 | 39.7 |
| 2.0 × 3.5 | 220 | 42 | 618 mA | 8.40 | 24 | 98 | 140 | 37.7 |
| 2.0 × 3.5 | 260 | 42 | 697 mA | 7.74 | 21 | 89 | 125 | 38.8 |

The assumptions made for Table 5 are: two core metal layers, copper thickness variation: ±5 μm, and trace width variation: ±20 μm. The results show excellent inductance across manufacturing variation: 7.74 nH-8.42 nH (±5%). The results also show a worst case direct current resistance of <30 mOhm and 50 MHz ACR <100 mOhm. The worst case Q Factor is greater than 37 @100 MHz. Note that the area is 2.0×3.5=7.0 square mm, which is only 30% of the area that a build-up layer inductor would occupy.

Figure 9:
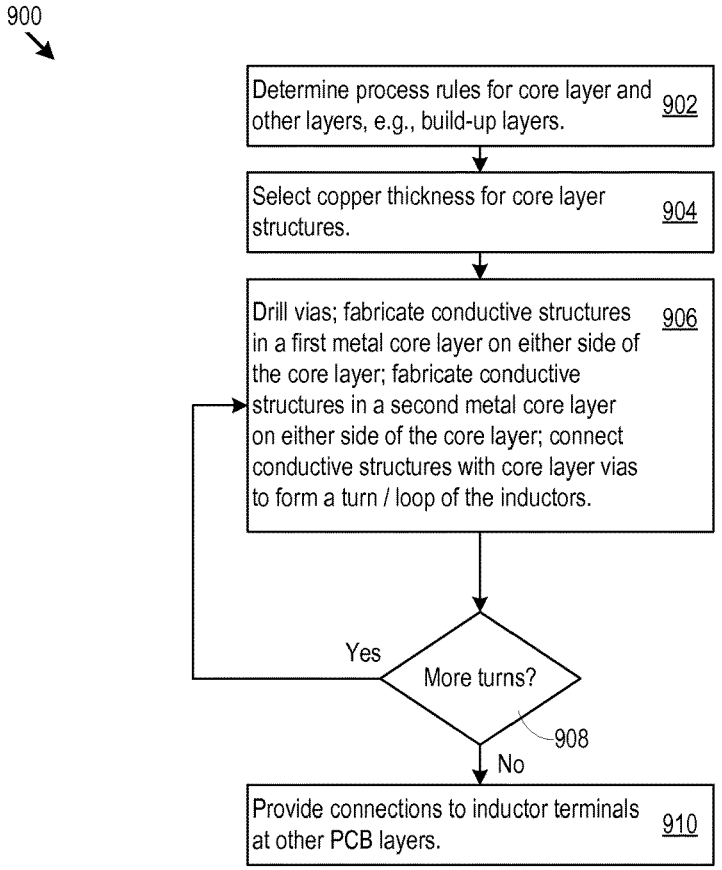
FIG. 9 shows a fabrication method for an inductor.

FIG. 9 shows a fabrication technique 900 for an inductor. Fabricating the inductors includes determine process rules for the core layer and other layers, e.g., a core layer and build-up layers of a package manufacturing process (902). Given the process rules, the copper thickness for core layer structures may be selected (904). There may be many different thicknesses to select from, based upon current handling design parameters, size constraints, cost, and other factors. The process rules for the core layers, and noted above, generally permit thicker, heavier core metal layers.

The fabrication technique 900 also includes multiple package fabrication processes to form as many build-up layers as desired on a core layer, and to fabricate an inductor that uses the core layer as part of its structure, and any of the build-up layers to define metal traces or segments of the inductor that are connected to form loops of the inductor. These processes may include, as just a few examples, providing a core layer; fabricating (e.g., drilling) vias; fabricating conductive structures for inductors in a first metal core layer; fabricating conductive structures for the indictors in a second metal core layer; connecting the conductive structures with core layer vias through the core layer to form a turn/loop of the inductors (906). The fabrication technique 900 may create as many turns as desired (908). In addition, the fabrication technique 900 may fabricate connections to inductor terminals at other package layers (910), e.g., by providing vias from build-up signal layers in the package down to the core metal layers at the inductor terminals.

The inductors provide an embedded substrate inductor solution. The inductors are fabricated with a core spiral structure to help increase inductance, and some implementations may use magnetic field coupling between inductors to boost inductance. One or more trace layers of the inductors are fabricated in core metal layers, according to the core layer design rules of the selected package manufacturing process. The core layer design rules may provide thicker trace lines and heavier copper thickness, compared to, for instance, a build-up layer or other layer defined by the package manufacturing process.

FIG. 10 shows an example inductor structure 1000 defining four inductors 1002, 1004, 1006, and 1008, each with three turns. FIG. 11 shows a top view of the inductor 1000 of FIG. 10. FIG. 12 shows a bottom view 1200 of the inductor of FIG. 10. Note that the turns of the inductor 1000 form loops in the same direction, e.g., counter clockwise starting from the input terminals 1010, 1012 to the common output terminal 1014. This may provide a more symmetric structure for the inductor 1000, compared to a design (e.g., FIGS. 1 and 3) in which the loops run in opposite directions to provide enhanced magnetic coupling and higher inductance.

Figure 13:
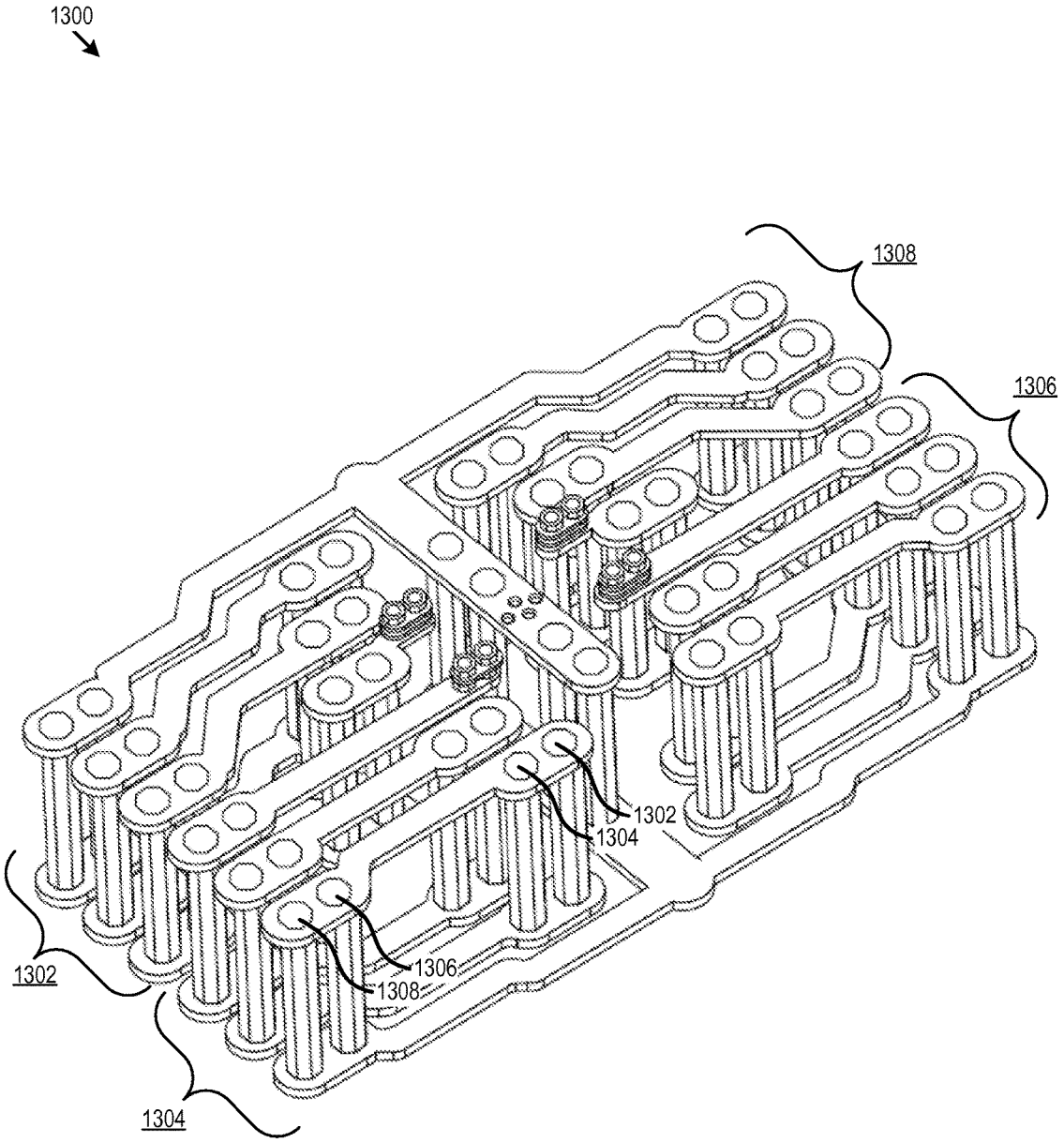
FIG. 13 shows an example inductor structure defining four inductors, each with three turns.
Figure 14:
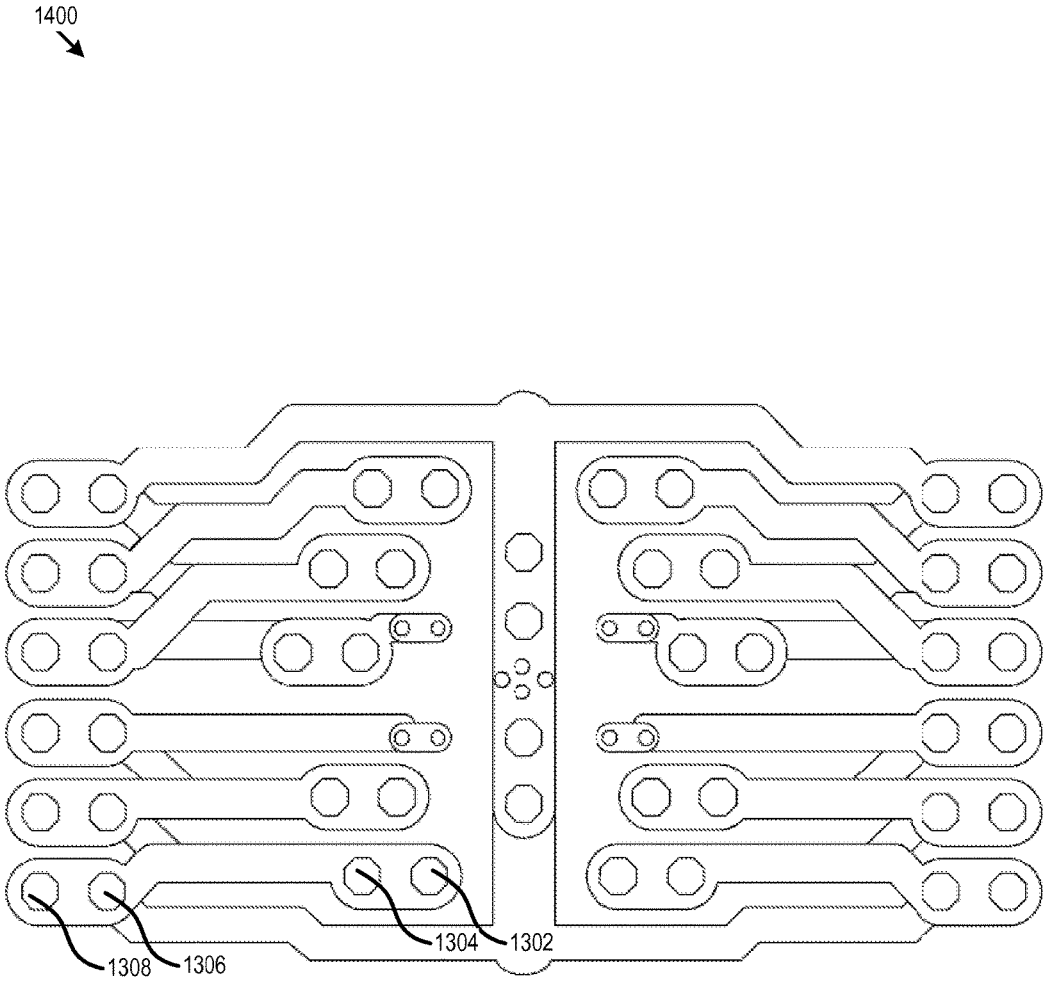
FIG. 14 shows a top view of the inductor of FIG. 13.
Figure 15:
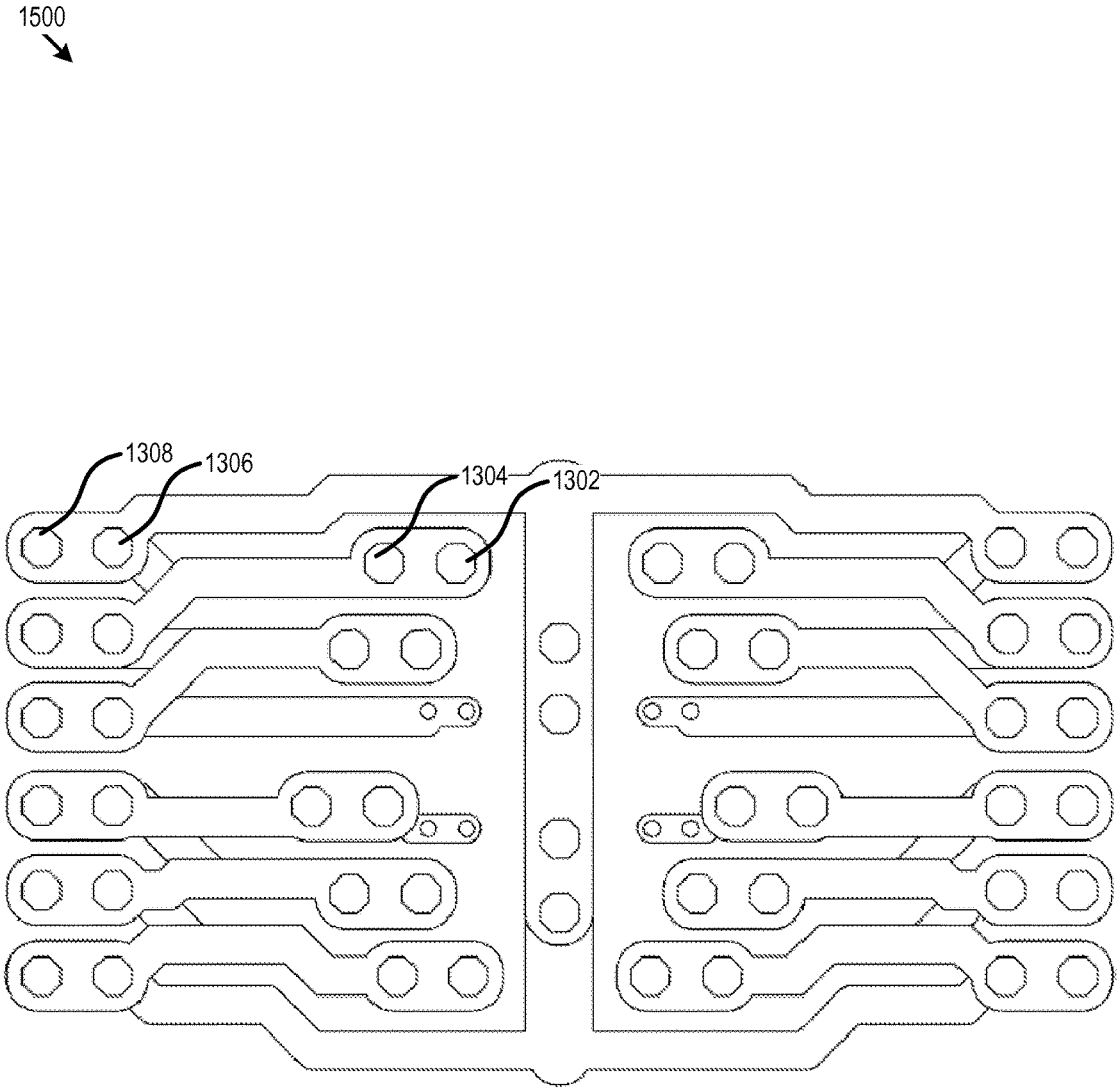
FIG. 15 shows a bottom view of the inductor of FIG. 13.

FIG. 13 also shows an example inductor 1300 structure defining four inductors 1302, 1304, 1306, and 1308, each with three turns. FIG. 14 shows a top view 1400 of the inductor of FIG. 13. FIG. 15 shows a bottom view 1500 of the inductor of FIG. 13. The inductor in FIGS. 13-15 is a variation of the three turn inductor shown in FIGS. 1-2, including opposite direction loops, but additional via interconnects.

In particular, the inductor 1300 uses multiple vias in parallel to connect each conductive segment that forms the loops of the inductor, e.g., the two vias 1302 and 1304 in parallel, and the two vias 1306 and 1308 in parallel. There may be an number of such vias in parallel, and the number in parallel may vary from location to location in the inductor structure. The multiple vias in parallel reduce the resistance of the connections between the conductive segments and allow for more current, thereby improving the electrical characteristics of the inductor 1300. Parallel vias in any selected structural locations may also be present in the inductor structures shown in FIGS. 3 and 10.

What is claimed is:

1. An inductor comprising:

a first conductive segment fabricated in a first core metal layer of a semiconductor package;

a second conductive segment fabricated in a second core metal layer of the semiconductor package;

a third conductive segment fabricated in the second core metal layer of the semiconductor package;

a first conductive core via through a core dielectric layer of the semiconductor package, the first conductive core via in contact with a first end of the first conductive segment and a first end of the second conductive segment;

a second conductive core via through the core dielectric layer of the semiconductor package, the second conductive core via in contact with a second end of the second conductive segment and a first end of the third conductive segment; and an inductor terminal via connecting the first conductive segment to a fourth conductive segment within a build-up layer of the semiconductor package, wherein the first, the second, and the third conductive segments are fabricated with thicknesses that are greater than a thickness of the fourth conductive segment within the build-up layer.

2. The inductor of claim 1, wherein the semiconductor package is fabricated using fabrication design rules that permit thicker lines in the core metal layers than in the build-up layer.

3. The inductor of claim 2, where:

the fabrication design rules require greater pitch for metal lines in the core metal layers than in the build-up layer.

4. The inductor of claim 1, where the first conductive segment comprises a horizontal displacement.

5. The inductor of claim 1, where:

the first conductive segment is arranged to conduct current in a direction opposite the second conductive segment.

6. The inductor of claim 5, where:

the first conductive segment comprises a horizontal displacement arranged to provide a horizontal offset for an additional conductive segment fabricated in the second core metal layer.

7. The inductor of claim 5, where:

the second conductive segment comprises a horizontal displacement arranged to provide a horizontal offset for an additional conductive segment fabricated in the first core metal layer.

8. The inductor of claim 1, further comprising a common connection from the inductor terminal to at least one additional inductor terminal.

9. The inductor of claim 1, where:

the first conductive segment, second conductive segment, and conductive core form a first turn of the inductor.

10. The inductor of claim 9, further comprising:

a second turn of the inductor coupled to the first turn.

11. The inductor of claim 10, where the second turn comprises:

a third conductive segment fabricated in the first core metal layer; and a fourth conductive segment fabricated in the second core metal layer.

* * * * *